US006018118A

United States Patent [19]

Smith et al.

[11] Patent Number: 6,018,118

[45] Date of Patent: Jan. 25, 2000

[54] SYSTEM AND METHOD FOR CONTROLLING A MUSIC SYNTHESIZER

[75] Inventors: Geoffrey M. Smith, Palo Alto; Mark H. Goldstein, Menlo Park; John W. Eichenseer, San Francisco; Michael B. Brook, Los Angeles; Robert L. Adams, Stanford, all of Calif.

[73] Assignee: Interval Research Corporation, Palo Alto, Calif.

[21] Appl. No.: 09/056,354

[22] Filed: Apr. 7, 1998

[51] Int. Cl.[7] ..... G10H 7/00

[52] U.S. Cl. ..... 84/600; 84/617

[58] Field of Search ..... 84/600, 615, 617, 84/618, 645, 653, 655, 656, 743

[56] References Cited

PUBLICATIONS

McMillen, "*Thunder User's Guide*", Buchla & Assoc., Feb. 9, 1990, pp. 1–61.

Anderton, "STEIM: In The Land Of The Alternate Controllers", Keyboard, Aug. 1994, pp. 54–62.

Goldstein et al. "*The Yamaha VL1™ Uncovered*," Interval Research Technical Report #1996–031, Dec. 1996.

Author Unknown, "*StarrLabs MIDI Controllers*", Internet address: http://catalog.com/starrlab/xtop.htm Dec. 4, 1997.

Paradiso, "Electronic Music: New Ways To Play", IEEE Spectrum, Dec. 1997, pp. 18–30.

Author Unknown, "*Korg On–Line Prophecy Solo Synthesizer*", NetHaven, Division of Computer Associates, 1997, Internet address: http://www.korg.com/prophecy1.htm.

*Primary Examiner*—Jeffrey Donels

*Attorney, Agent, or Firm*—Pennie & Edmonds LLP

[57] ABSTRACT

A signal mapping system maps sensor signals into control signals that control the operation of a music synthesizer. A "one to many" mapping technique is used, allowing at least some of the sensor signals to each be mapped into numerous music synthesizer control signals. Physical gestures by a user are mapped into a large set of music synthesizer control signals, some of which continuously vary in value as the user moves through the gestures. Signal mapping functions are used to map the sensor signals into note number and velocity values for at least one voice to be generated by the music synthesizer. The note number and velocity values are sent to the music synthesizer as note-on events when predefined note-on and note-off trigger conditions, defined with respect to specified ones of the sensor signals, are satisfied. Other ones of the signal mapping functions are used to generate asynchronous control signals that are sent to the music synthesizer independent of the note-on and note-off events. A third set of signal mapping functions are used to generate the trigger signals for determining when note-on and note-off events are to be sent to the music synthesizer.

16 Claims, 6 Drawing Sheets

SYSTEM AND METHOD FOR CONTROLLING A MUSIC SYNTHESIZER

The present invention relates generally to electronic music synthesis using digital signal processing techniques, and particularly to a system and method for controlling a music synthesizer by mapping a small number of continuous range sensor signals into a larger number of control signals that are then used to control the music synthesis operations of the music synthesizer.

BACKGROUND OF THE INVENTION

Music synthesis using digital signal processing techniques is well known. Many commercially available music synthesizers utilize electronic circuitry performing numerical operations on digital signals to generate music and other acoustic signals. For instance, many "electronic keyboards" work this way.

Typically, such music synthesizers have a keyboard, a number of buttons for selecting various options, and perhaps a number of sliders and/or wheels for controlling various parameters of the synthesizer. While the synthesizer's various control parameters are accessible via these input devices, typically only a very small number (e.g., one or two) of control parameters are affected by each key press on the keyboard. In particular, each key press generates a MIDI note-on event that sends a note and velocity data pair to the synthesizer. When the key is released, a MIDI note-off event is generated. Note, however, that the prior art music synthesizers do not give the user a practical way to continuously modify more than a couple of the synthesizer parameters. That is, the user's access to parameters other than pitch and amplitude is severely limited by the number of sliders and buttons the user can simultaneously manipulate while also performing whatever actions are needed to "play notes" or otherwise control the pitch and amplitude of the voices being generated by the synthesizer.

Future generations of music synthesizers are likely to have even more user controllable control parameters than current synthesizers, in part to accommodate increasing complex music synthesis models. This raises the issue as to how users will be able to effectively utilize such music synthesizers, since current technology does not provide any simple, intuitive techniques for updating large numbers of control parameters. Rather, current technology tends to set most of these parameters just once, when a particular "instrument model" is chosen, and then transmits values for a relatively small number of control signals while the instrument is actually being played. While the user might be able to change the instrument model selection while playing, the user is not given control over individual ones of most of the control parameters, and it is also not practical to change the instrument model selection numerous times per second in the same way that numerous notes can be played in a short period of time. There are only so many dials, sliders, pitch wheels, foot pedals and the like that a user can effectively utilize while also playing notes. Thus, music synthesizers having numerous control parameters can be described as being "signal-hungry." Current technologies are providing users with very limited access to music synthesizer control parameters, whereas the music synthesizers could easily handle a much higher volume of control parameter updates.

The inventors of the present invention have discovered that new and pleasing musical sounds can be generated by simultaneously and continuously updating many of a music synthesizer's control parameters, especially when those control parameters are made responsive to a user's physical gestures. It is therefore a primary goal of the present invention to provide an apparatus that makes it easy for users to simultaneously and continuously modify many of a music synthesizer's control parameters.

Another object of the present invention is to circumvent the limitations of MIDI note-on and note-off events, so as to generate more continuously varying musical sounds. A related object of the present invention is to give the music synthesizer user direct control over the attack and release of each note. More specifically, it is a goal of the present invention to provide a mechanism for varying pitch and amplitude of one or more voices without having to generate corresponding MIDI note-on and note-off events and without having the music synthesizer impose attack and note-off envelopes on the amplitude of the notes being played.

SUMMARY OF THE INVENTION

The present invention is a signal conditioning and mapping system and method for mapping sensor signals into control signals that control the operation of a music synthesizer. A "one to many" mapping technique is used, allowing at least some of the sensor signals to each be mapped into numerous music synthesizer control signals. Physical gestures by a user are mapped into a large set of music synthesizer control signals, some of which continuously vary in value as the user moves through the gestures.

The signal mapper will typically have a data processing unit for executing a set of signal mapping functions, an input port for receiving the sensor signals, an output port for sending control signals to the music synthesizer, and a memory for storing data and instructions representing the set of signal mapping functions for execution by the data processing unit.

Some of the signal mapping functions are used to map the sensor signals into note number and velocity values for at least one voice to be generated by the music synthesizer. (MIDI note numbers are converted into pitch values by the synthesizer, sometimes in conjunction with other parameters provided to or generated by the synthesizer.) The note number and velocity values are sent to the music synthesizer as note-on events when predefined note-on and note-off trigger conditions are satisfied. Other ones of the signal mapping functions are used to generate asynchronous control signals that are sent to the music synthesizer independent of the note-on and note-off events.

Each of the signal mapping functions is defined by a respective set of parameters. For instance, the set of parameters for a signal mapping function may include a Min/Max range of control signal values and a parameter specifying one of a predefined set of linear and non-linear mathematical functions to be used for mapping the specified sensor signal to the specified Min/Max range of control signal values.

In a preferred embodiment, a first pair of the sensor signals represents a location where a user is touching a first sensor and an amount of force with which the user is touching the first sensor, and a second pair of the sensor signals represent a location where a user is touching a second sensor and an amount of force with which the user is touching the second sensor. The control signals generated by the signal mapping functions preferably include at least two control signals selected from the set consisting of pressure, embouchure, tonguing, breath noise, scream, throat formant, dampening, absorption, harmonic filter, dynamic filter, amplitude, portamento (speed of gliding between pitches) growl, and pitch. The amplitude control signal is a signal that is multiplied by the velocity control signal for at least one voice generated by the music synthesizer, and the pitch control signal is a signal that is added to the pitch associated with the note number for the at least one voice generated by the music synthesizer.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENTS

Figure 1:
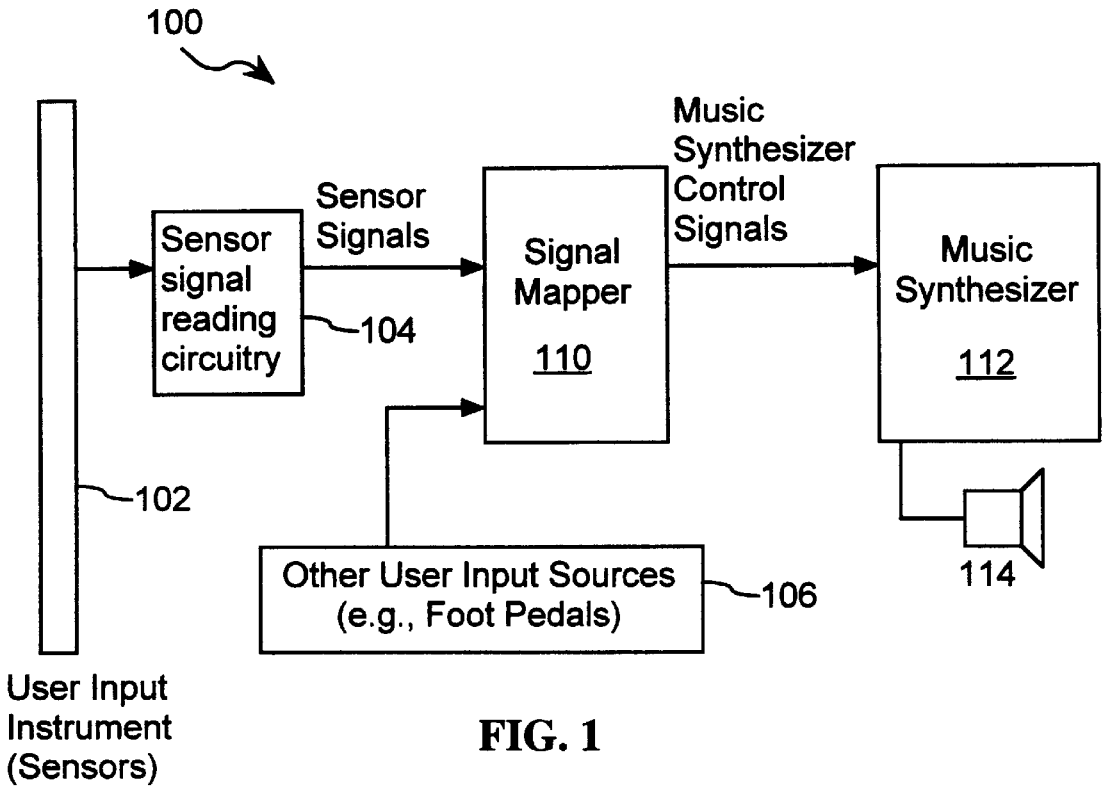
FIG. 1 is a block diagram of a music synthesizer system in accordance with a preferred embodiment of the present invention.

Referring to FIG. 1, there is shown a music synthesis system 100 having:

- a user input device 102 that generates a set of user input signals, preferably in response to movement and pressure applied by a user's fingers to sensors on the input device 102;
- sensor reading circuitry 104 for reading user input signals generated by the user input device 102;
- other, optional, user input signal sources 106, such as foot pedals;
- a signal mapper 110, which maps user input signals into music synthesis control signals;
- a music synthesizer 112, such as the Yamaha VL1-M Virtual Tone Generator (Yamaha and VL1 are trademarks of Yamaha . . . ); the music synthesizer generates an audio frequency output signal in response to the control signals received from the signal mapper 110; and
- one or more audio speakers 114 for converting the audio frequency output signal into audible music (i.e., acoustic energy).

The present invention can be used with a wide variety of music synthesizers, so long as there is a way to communicate in real time a changing set of control parameters to the music synthesizer 112. The VL1-M used in the preferred embodiment is just one example of a suitable music synthesizer.

It should be noted that the term "pitch" is ambiguous: sometimes it means "note number" and sometimes it means the frequency of a note or voice. For instance, it is common to say that "pitch and velocity" parameters are sent to a music synthesizer whenever a note-on event occurs; however, what is really sent to the music synthesizer are note number and velocity values. As will be explained more below, instantaneous pitch is determined by the music synthesizer based both on the note number and other parameters.

Figure 2:
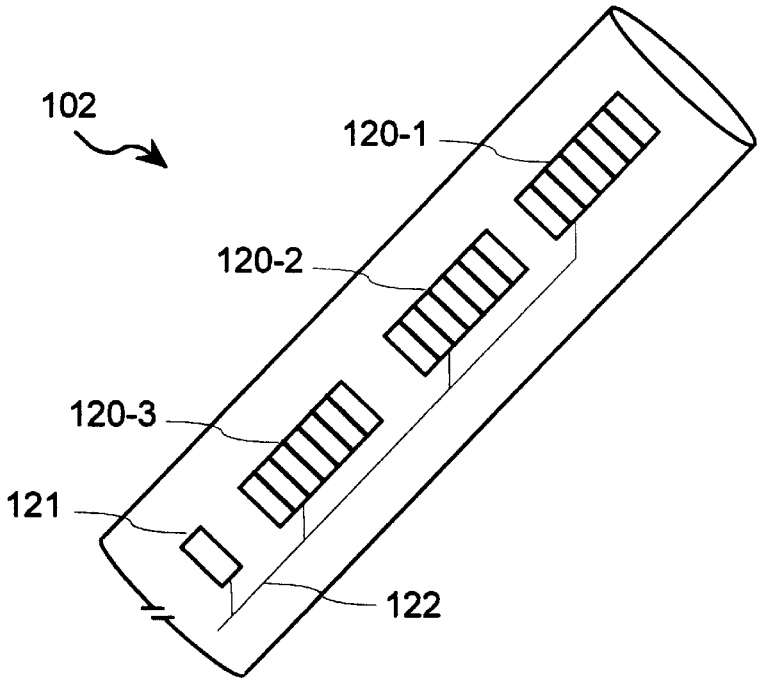
FIG. 2 depicts a user interface suitable for generating a plurality of user input signals.

Referring to FIGS. 1 and 2, in a preferred embodiment the user input device 102 is an instrument, sometimes called "the stick" due to its long thin shape, having a plurality of sensor elements 120, 121 on it. In the preferred embodiment, the instrument 102 has four sensors 120-1, 120-2, 120-3 and 121 on it, although the number of sensors could be less or more in other embodiments of the invention. Each sensor **120-*i* is a "force sensitive resistor" (FSR) that, in combination with the sensor signal reading circuitry 104, generates two output signals: one (LOCi) indicating the position at which it is being touched (if any), and a second (FRCi) indicating the amount of force (if any) being applied to the sensor, where "i" is an index indicating which one of the sensors produced the sensor signals. Thus, when a user touches sensor 120-*i* with one of his/her (hereinafter "his", for simplicity) fingers, the signal mapper 110 receives two signals LOCi and FRCi indicative of the position and force with which the user is touching the sensor 102-*i***.

The fourth sensor 121, called the drum sensor, generates a signal (DRUM) whenever the instrument 102 is tapped or hit by the user (e.g., by one of the user's fingers) with sufficient force to be detected by the sensor 121. The DRUM sensor signal indicates the magnitude of the force with which the instrument 102 was tapped or hit. The sensor signals generated by the sensors 120, 121 are transmitted via a communications cable 122 to the signal mapper 110 (FIG. 1).

In alternate embodiments, more than one drum sensor could be used, for instance to detect the location or angle at which the user strikes the instrument 102.

While the preferred embodiment uses force sensitive resistors to receive and parameterize a person's gestures, in other embodiments other types of multidimensional sensors could be used for this purpose. Such multidimensional sensors might generate signals corresponding to the position of person's finger or hand, or the position of a baton held by the person, in a two or three dimension reference frame. The sensors in other alternate embodiments could simulate wind instrument operation by measuring breath pressure, tongue pressure and position, lip pressure, and so on.

Further, in alternate embodiments sensor signals could be recorded and then introduced at a later time to the signal mapper 110. In such embodiments the rate at which the sensor signals are sent to the signal mapper 110 could be the same, or slower or faster than the rate at which they were originally generated.

The signal mapper 110 maps the six FSR signals LOC1, FRC1, LOC2, FRC2, LOC3, and FRC3, the drum signal DRUM, and the two foot pedal signals FS1 and FS2 into control parameters for the music synthesizer. More particularly, all changes in the sensor signals are converted by the signal mapper 110 into MIDI signals that are sent to the music synthesizer 112. These MIDI signal specify control parameter values.

In alternate embodiments, the control parameters sent to the music synthesizer could be encoded using a standard or methodology other than MIDI. Generally, the control parameters or signals sent to the music synthesizer can encoded using whatever methodology is appropriate for that music synthesizer. However, since MIDI is the most widely used standard, the preferred embodiment will be described in terms of sending control parameters as MIDI signals.

The music synthesizer 112 has, in addition to note number and velocity parameters for two or more voices, numerous other control parameters. In a preferred embodiment, the music synthesizer's control parameters correspond to physical model parameters for wind instrument synthesis. Those control parameters include: pressure, embouchure, tonguing, breath noise, scream, throat formant, dampening, absorption, harmonic filter, dynamic filter, amplitude, portamento, growl, and pitch. These other control parameters are delivered to the music synthesizer asynchronously with respect to note-on and note-off events. In other words, MIDI events conveying the values of these control parameters are sent to the music synthesizer without regard to when note-on and note-off events are sent to the music synthesizer. Preferably, for each of these asynchronous control signals, a MIDI event is sent to the music synthesizer whenever the control signal's value changes from prior value during the immediately previous sample period.

For the purposes of this document, a signal or parameter is said to vary "continuously" if the signal or parameter is typically updated more frequently (in response to the user's physical gestures) than note-on events are generated. More generally, the "continuously" updated control parameters are updated whenever the corresponding sensor signals vary in value, regardless of whether or not those sensor signal value changes cause note-on events to be generated.

It should be noted that note number and velocity parameters are generally not updated and retransmitted to a music synthesizer continuously. Rather, a note number and velocity pair is typically sent for each distinct gesture by the user that corresponds to a new note on event. The velocity parameter is usually used by a synthesizer to determine amplitude, or to determine a vector of amplitude values over a note's duration. Since the velocity parameter is indicative of the "velocity" of the gesture which caused the note-on event, the velocity parameter is not a suitable control parameter for modifying a note's amplitude while the note is being played. As will be described next, other control parameters are used to modify a note's pitch and amplitude while the note is being played.

The pitch and amplitude control parameters differ from the pitch source (i.e., note number) and velocity parameters. For each voice of the music synthesizer, sound is generated when a MIDI note-on event is generated. The MIDI note-on event indirectly specifies a pitch value by specifying a predefined MIDI note number, and also specifies a velocity value.

In the preferred embodiment the instantaneous pitch of a note (also called a voice) is the sum of:

1) the pitch corresponding to the note number issued at the time of the note-on event, multiplied by the value of a time-varying pitch envelope (if any) associated with the note;
2) the value of a time-varying LFO (low frequency oscillator), if any, assigned to the note; and
3) the current value of the pitch control parameter.

Furthermore, any of these parameters (i.e., the initial pitch, pitch envelope, LFO and pitch control parameter, can optionally be scaled in the synthesizer by a "sensitivity" factor. If the optional time-varying pitch envelope and LFO are not used for a particular note, and the sensitivity factors for the pitch parameters are set at their 1.0 default value, then the instantaneous pitch is the sum of the pitch corresponding to the note number issued at the time the note-on event and the current value of the pitch control parameter.

The pitch control parameter is used in an additive manner to modify the pitch specified in the MIDI note-on event for each music synthesizer voice. The pitch control parameter has a value that is preferably scaled in "cents," where each cent is equal to 0.01 of a half note step (i.e., there are 1200 cents in an octave). For example, if the pitch value specified by a MIDI note-on event is 440 Hz and pitch control parameter is equal to 12 cents, the music synthesizer will generate a sound having a pitch that is twelve one-hundredths (0.12) of a half step above 440 Hz (i.e., about 443.06 Hz).

The amplitude control parameter is a value between 0 and 1. In the preferred embodiment the instantaneous amplitude of a note (also called a voice) is the product of:

1) the velocity issued at the time of the note-on event, multiplied by the value of an optional time-varying amplitude envelope associated with the note;
2) the value of a time-varying LFO (low frequency oscillator), if any, assigned to the note; and
3) the current value of the amplitude control parameter.

Furthermore, these parameters (i.e., the velocity, velocity envelope, LFO and amplitude control parameter, can optionally be scaled in the synthesizer by respective assigned "sensitivity" factors. If the optional time-varying amplitude envelope and LFO are not used for a particular note, and the sensitivity factors for the amplitude parameters are set at their 1.0 default value, then the instantaneous amplitude of a note is obtained by multiplying (inside the music synthesizer) the amplitude control parameter by the note's velocity value. In other embodiments other mathematical functions could be applied to as to combine the velocity and amplitude values. In summary, the amplitude of a note is a function of both the note-on velocity, which stays constant until there is a corresponding note-off event, and the amplitude control signal, which can vary continuously as a corresponding sensor signal varies in value.

After the structure of the signal mapper 110 is described, the various sensor signal to control parameter mappings will be explained in more detail.

Figure 3:
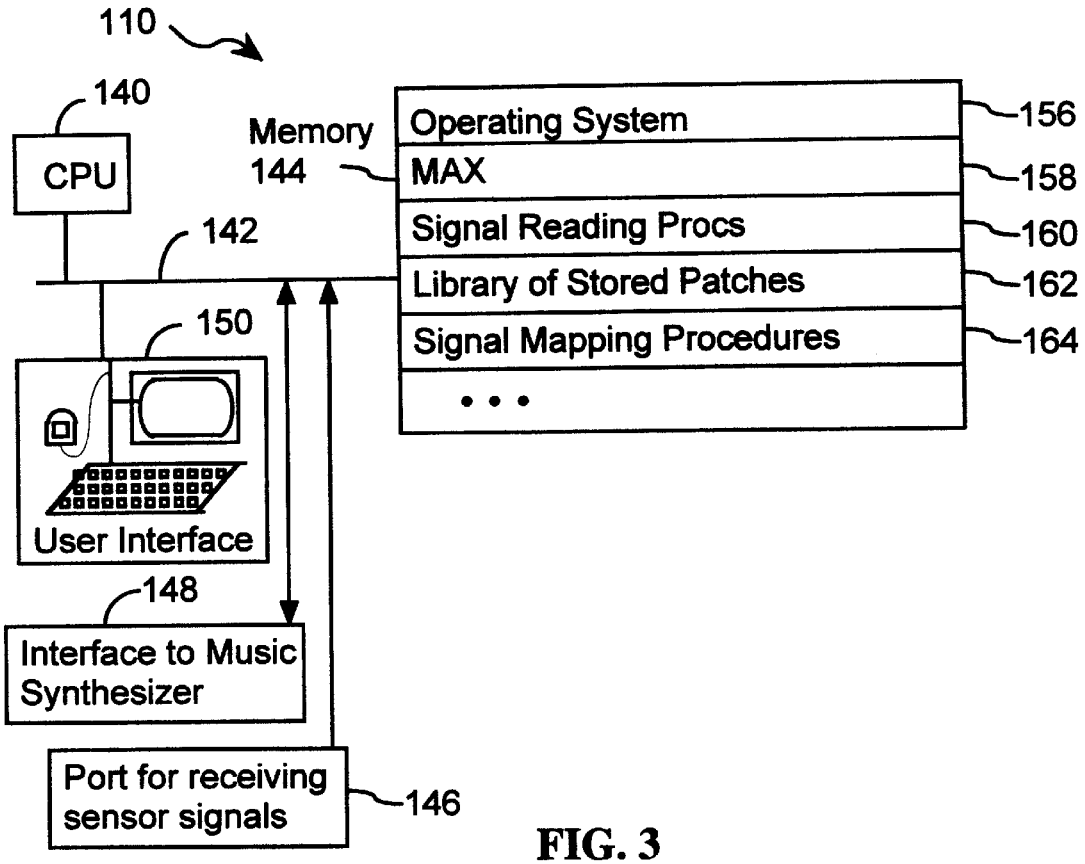
FIG. 3 depicts a computer system suitable for mapping user input signals into a set of music synthesizer control signals.

Referring to FIG. 3, the signal mapper 110 may be implemented using a general purpose computer, such as PowerPC Macintosh or a desktop Pentium processor, or a proprietary processor. Regardless of the type of computer used, the signal mapper 110 will typically include a data processor (CPU) 140 coupled by an internal bus 142 to memory 144 for storing computer programs and data, one or more ports 146 for receiving sensor signals, an interface 148 for sending and receiving signals and data to and from the music synthesizer, and a user interface 150. However, in alternate embodiments the signal mapper might be implemented as a set of circuits (e.g., implemented as an ASIC) whose operation is controlled by a set of patch parameters.

The user interface 150 is typically used to select a "patch", which is a data file defining a mode of operation for the music synthesizer as well as defining how the sensor signals are to be mapped into control signals for the music synthesizer. Thus, the user interface can be a general purpose computer interface, or in commercial implementations could be implemented as a set of buttons for selecting any of a set of predefined modes or operation. If the user is to be given the ability to define new patches, then a general purpose computer interface will typically be needed. Each mode of operation will typically correspond to both a "physical model" in the synthesizer (i.e., a range of sounds corresponding to whatever "instrument" is being synthesized) and a mode of interaction with the sensors.

The memory 144, which typically includes both high speed random access memory and non-volatile memory such as magnetic disk storage, may store:

an operating system 156, for providing basic system support procedures;

MAX 158 (named in honor of music synthesis pioneer Max Mathews), which is a well known real time signal processing module that provides a graphic programming language for specifying data flow paths and signal processing operations;

signal reading procedures 160 for reading the user input signals (also called sensor signals) at a specified sampling rate;

a library of patches 162, where each patch is essentially a data structure storing a set of parameter values that specify a mode of musical synthesis; and signal mapping procedures 164, written in the MAX language, for mapping the sensor signals into music synthesizer control signals in accordance with a selected patch.

As will be understood by those skilled in the art, the particular operating system used and the particular signal processing module(s) used will vary from one implementation to another. Thus, for example, while MAX is used in the preferred embodiment, other embodiments use other programming languages and other real time signal processing modules.

The signal mapping procedures 164 implement the sensor signal to control signal mappings specified in the selected patch. In the preferred embodiment, the sensor signals are periodically sampled at a rate determined by a global sample rate parameter. Each patch specifies the sample rate to be used with that patch. For example, the sample rate for a patch may be specified as a number of milliseconds between samples. A sample time of 8 ms would correspond to a sample rate of 125 times per second. It should be noted that the sensor sample rate is not the audio sample rate of the synthesizer, which will typically be well over 10 kilohertz.

Furthermore, the signal mapping system 110 generates control signals at the same rate as the sample rate. More specifically, once per sample period, a MIDI event is generated for each control signal that has changed in value since the immediately preceding sample period. Thus, for instance, if the sample period is 8 ms, MIDI events are generated and sent to the music synthesizer every 8 ms. If the system is in active use, MIDI events are typically being generated during a large percentage of the sample periods because the user's fingers on the sensors rarely remain completely static with respect to both position and pressure. Even small changes in pressure or small movements of the user's fingers on the instrument may cause value changes in some of the control signals, causing the generation of MIDI events.

Thus, unlike traditional music synthesizers in which the rate of MIDI events is relatively low, occurring only when there are note-on and note-off events, in the present invention there is a veritable torrent of MIDI events being generated. This large volume of MIDI events tends to generate rich, complex sounds that are often more pleasing to the ear than the sounds traditionally generated by music synthesizers.

Mapping Sensor Signals to Control Signals

Figure 4:
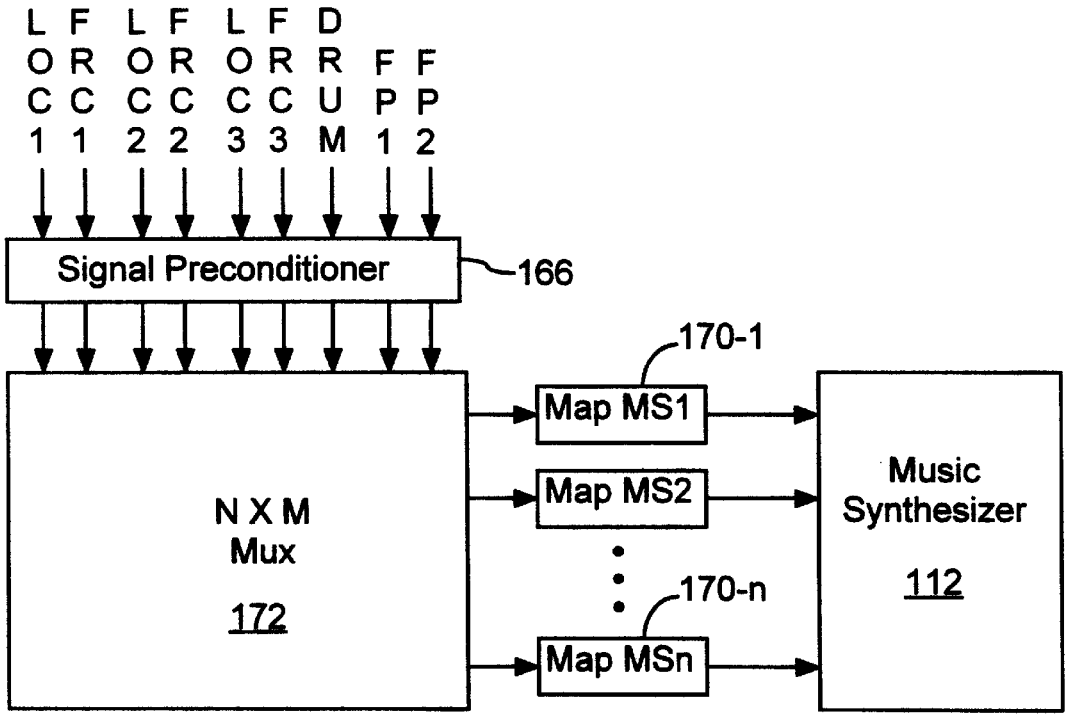
FIG. 4 is a signal flow diagram representing operation of the signal processing procedures executed by the computer system of FIG. 4.

FIG. 4 diagrammatically represents the process of mapping sensor signals into control signals. The signal mapping "module" (i.e., the selected patch from library 162 and the signal mapping procedures 164) receives nine sensor signals in the preferred embodiment: LOC1 and FRC1 from FSR1, LOC2 and FRC2 from FSR2, LOC3 and FRC3 from FSR3, DRUM from the drum sensor, and foot pedal signals FS1 and FS2. The signal mapping module generates n control or output signals MS1 to MSn, where the number of control signals generated is typically larger than the number of sensor signals. Generally, most of the FSR derived signals undergo a "one to many" mapping such that each LOCx and FRCy signal is mapped into two or more music synthesizer control signals.

Each of the sensor signals is preconditioned by a signal preconditioning module 166 before being passed to a multiplexer 172. The preconditioning module limits each sensor signal a respective predetermined min/max range. If a sensor signal's value is less than its respective predetermined minimum, no signal passes to the multiplexer 172. If the sensor signal's value is greater than its predetermined maximum then the predetermined maximum is passed to the multiplexer. When a sensor signal crosses its predefined minimum threshold an "in" or"out" signal is generated (depending on whether the sensor signal is coming into the predefined range, or is going out of range) and passed through the multiplexer 172.

The signal mapping module includes a signal scaling and mapping function 170-*i* for each control signal MSi. A multiplexer 172 (implemented in software) maps one of the sensor signals to each of the mapping functions in accordance with a sensor signal selection parameter 174 (see FIG. 5). However, in some patches some of the control signals are unused, and therefore no sensor signals are coupled by the multiplexer 172 to the signal mapping functions for the unused control signals. The multiplexer 172 operates somewhat like a crossbar switch, except that each input (sensor) signal can be coupled to more than one of the output (control) signal ports of the multiplexer 172.

The signal mapping functions implemented by the signal mapper in the preferred embodiment can be grouped into three classes: functions for mapping sensor signals into sample and hold control value (e.g., velocity and note number), functions for mapping sensor signals into continuous control signals, and functions for mapping sensor signals into trigger controls signals (where trigger signals are used to determine when note on and note off events occur). Due to the "one to many" mapping technique of the present invention, it is possible for a sensor signal to be mapped into all three types of control signals.

Each of the signal mapping functions is defined by a respective set of parameters, preferably including a Min/Max range of control signal values, and a parameter specifying one of a predefined set of linear and non-linear mathematical functions to be used for mapping the specified sensor signal to the specified Min/Max range of control signal values. In alternate embodiments, some control signals could be mapped into a plurality of value regions, with unused value ranges between them. This might be done, for instance, to avoid "bad" control value regions that are known to cause inappropriate or catastrophic synthesizer sound events, while still providing a wide range of control values. This type of multiple region mapping could also be used to produce interesting sound effects.

Figure 5:
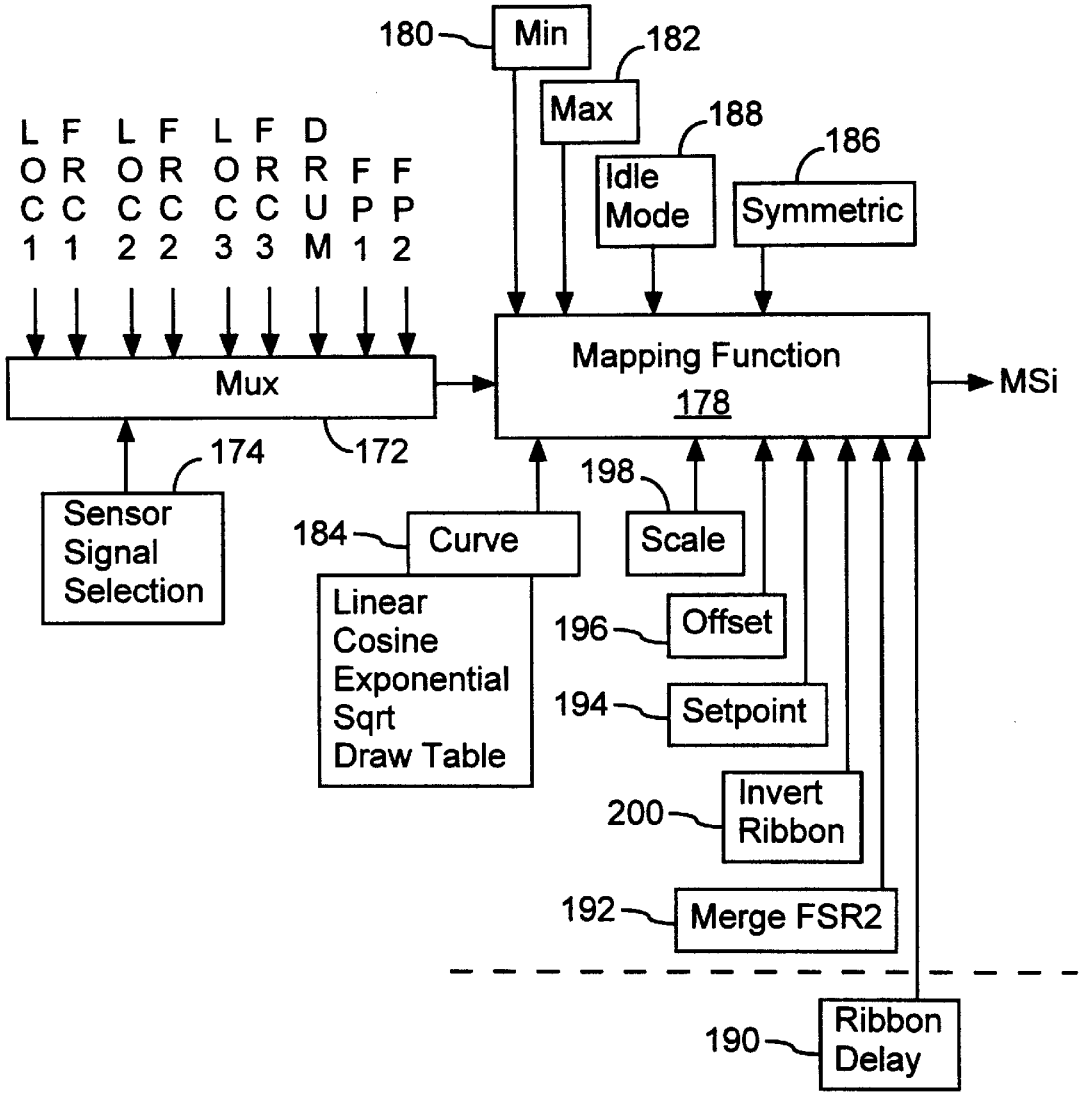
FIG. 5 depicts the parameters and process for generating some of the control signals used by a music synthesizer.

More specifically, referring to FIG. 5, each of the asynchronous control signals is generated using an instance of a mapping function 178 that is specified by the following parameters:

Min 180 and Max 182, define the minimum and maximum bounds to which the selected sensor signal will be mapped. Normally Min is defined to be less than Max. If, however, Min is defined to be larger than Max, the mapping of the sensor signal to the control signal is inverted (i.e., reflected about the y axis).

Curve 184, specifies whether the sensor signal is to be mapped to the control signal using a linear, cosine, exponential or square root mapping. Alternately, the programmer can specify a lookup table for defining the mapping from sensor signal to control signal.

Symmetric 186, is a True/False parameter. When True, the mapping function is made symmetric so as to peak at the center value for the sensor signal. The mapping function defined by the Min, Max, Curve and Symmetric parameters is automatically scaled so that the full defined range of values for the specified sensor signal is mapped by the mapping function into control signals having the full range of values defined by the Min and Max parameters.

Idle Mode 188, refers to the MIDI value that will be transmitted when the sensor signal falls below the minimum value for the sensor. This happens when the user stops touching the sensor. The possible values for the Idle Mode parameter are Min, Max and Center (i.e., control signal is set to the minimum, maximum and average MIDI values for the control signal), zero, stay and ribbon. Stay means that control signal value is maintained at the last valid MIDI control value for the control signal, and no special action is taken when the user removes his finger from the sensor. The Ribbon option is not really an idle mode. When Ribbon is selected as the Idle Mode, the sensor signal is defined relative to the initial position (or pressure) read by the sensor when the user initially touches it (i.e., the initial position or pressure each time the user puts his finger down on the sensor). Since it takes time for the sensor to slew to the value representing the initial location or pressure, the initial sampling of the sensor is delayed by a number of milliseconds specified by a global Ribbon Delay parameter 190. The global Ribbon Delay parameter 190 defines the initial sensor sampling delay for all control signals generated using the ribbon mode of operation.

Merge FSR2 192 is used to configure two adjacent sensors FSR1 and FSR2, or FSR3 and FSR2 to operate as a single sensor. This option is applicable only when the main sensor signal being used to generate a control signal is FSR1 or FRS3. When the FSR2 merge parameter 192 is set to True, the maximum of the primary and FSR2 signals is selected and used to calculate the value of the associated control signal. For instance, the maximum of control signals LOC1 and LOC2 could be used to generate the embouchure control signal.

When the ribbon mode of operation is selected for generating a control signal, by setting the idle mode to ribbon, the control signal is generated in accordance with the Set Point 194, Offset 196, Scale 198 and Invert Ribbon 220 parameters. The Set Point parameter 194 specifies the initial MIDI value for the control signal when the sensor is first touched, and the Offset 196 specifies the maximum amount that can be added or subtracted to the set point. As the user's finger moves across the sensor, a signed delta signal is generated that is equal to the change in the sensor signal from its initial value when the sensor was first touched. The MIDI value for the control signal varies up and down in response to the movements of the user's finger, as a function of the signed delta signal.

The Set Point and Offset parameters 194, 196 override the Min and Max parameters when the ribbon mode of operation is selected for a particular control signal. The Curve 184 parameter continues to specify the manner in which the sensor signal is mapped to the control signal, except that in ribbon mode it is the change in the sensor signal from its initial value (i.e., the signed delta signal) that is mapped by the function specified by the Curve 184 parameter.

In ribbon mode, the delta sensor signal is scaled in accordance with the Scale parameter 198 instead of using the automatic scaling that is normally applied when ribbon mode is not in use. In other words, the signed delta signal is multiplied by the Scale value before the Curve function is applied to generate the control signal. The Scale 198 can be set anywhere from 1 to 1000. Finally, the Invert Ribbon parameter 200, if set to True, inverts (i.e., reflects with respect to the y axis) the direction of change in the control signal caused by changes in the selected sensor signal.

The sensor signal selection and mapping function shown in FIG. 5 are repeated for all of the music synthesizer control signals except the pitch and velocity control signals. In particular, one instance of the sensor signal selection and mapping function shown in FIG. 5 is used for each of the following control signals: pressure, embouchure, tonguing, breath noise, scream, throat formant, dampening, absorption, harmonic filter, dynamic filter, amplitude (i.e., multiplicative factor for voice velocities), portamento, growl, and pitch (i.e., additive factor for voice pitches).

Pitch and Velocity Mapping

Figure 6:
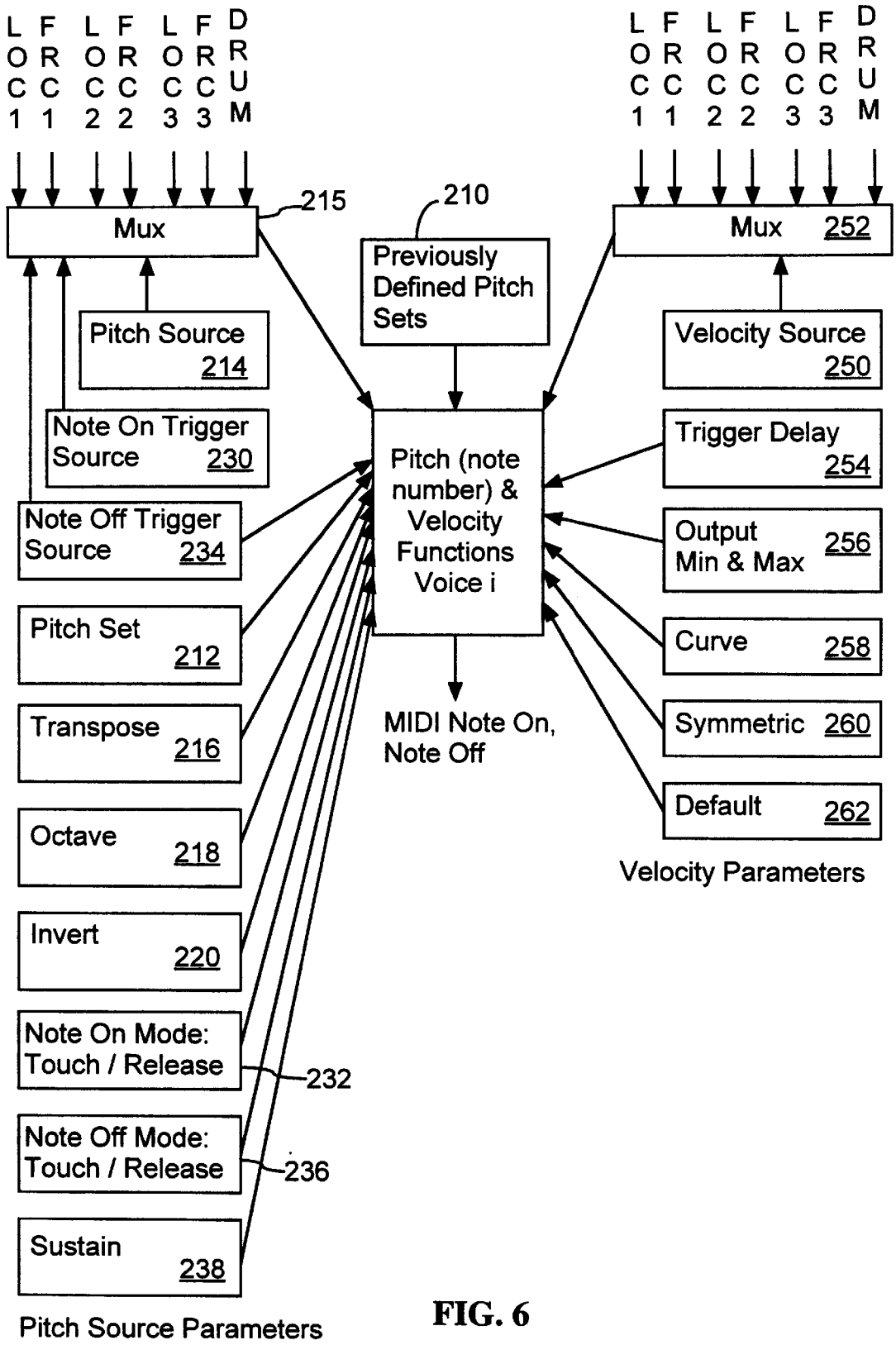
FIG. 6 depicts the parameters and process for generating pitch and velocity control signals used by a music synthesizer.

FIG. 6 depicts the set of parameters used to govern the generation of each of two voices. Each voice has a note number and a velocity, each of which is independently generated. Whenever a MIDI note-on event is generated by the pitch and velocity function(s) for a voice, the note-on event contains both a note number designation as well as a velocity. Therefore, every time there is a new note both note number and velocity values are generated.

The pitch source (i.e., note number) parameters include a set of previously defined pitch sets 210. Each pitch set consists of an ordered set of note values, also called note numbers (i.e., standard, predefined MIDI note values, each of which corresponds to a pitch or frequency value). If a pitch set has, say, an ordered set of eight notes, then a selected sensor signal (as defined by the pitch source parameter) will be divided into eight corresponding regions. The pitch set to be used for a particular voice i is specified by the corresponding pitch set parameter 212, and the sensor signal to be used as the pitch source (i.e., that is to be mapped into the pitches in the specified pitch set) is specified by the pitch source parameter 214 (which controls the signal selection by an associated multiplexer 215). The Transpose parameter 216 specifies the number of half steps that the pitches in the pitch set are to be transposed up or down, while the Octave parameter 218 specifies a transposition up or down in octaves.

The Invert parameter 220, if set to True, inverts the mapping from pitch source to pitch set.

The generation of MIDI note-on and note-off events is controlled by one or two specified sensor signals and is responsive to either the touching or releasing of the specified sensor(s). Thus, the Note-On parameters include a note-on trigger source parameter, which can specify any of the sensor signals, and a touch/release gesture type parameter 232 specifying whether touching or releasing the specified sensor triggers note-on events. In this context, "touch" means that the sensor signal rises above the sensor's calibration minimum, and "release" means that the sensor signal drops below that minimum. When the drum sensor is selected as the note-on trigger source, the touch/release parameter is ignored since the drum sensor only generates non-zero values when it detects the instrument being tapped. Thus, when the drum sensor is the trigger source, a note-on is generated any time the DRUM sensor signal has a non-zero value.

If the note-on trigger source 234 is specified as "off," then the pitch source itself triggers note-on events. That is, every time the pitch source signal changes enough to map to a new note number, a note-on event is automatically generated (as well as a note-off event for turning off the previously generated note, if any).

The note-off trigger parameters include a note-off trigger source 234 which can specify any of the sensor signals, and a touch/release gesture type parameter 236 specifying whether touching or releasing the specified sensor triggers note-off events. Trigger source parameter 234 controls note-off trigger signal selection by multiplexer 215. Note-off generation can be disabled, in which case the synthesizer is responsible for generating note-offs based on its own voice allocation scheme.

For keyboard-like on/off response, the best note-on trigger is the same LOC sensor signal that is used as the pitch source, with a note-on gesture type of "touch," and the best note-off trigger is the same LOC sensor signal that is used as the pitch source, with a note-off gesture type of "release." If the user slides a finger over the specified sensor without lifting it off the sensor, no MIDI note-on and note-off events are generated.

The sustain parameter 238 can be set to FS1, FS2 or OFF, to indicate whether the note trigger sources respond to pedal action. When either FS1 or FS2 is selected as the sustain parameter, if a note-off is issued while the specified foot switch pedal is down, the note-off is held (i.e., not sent to the synthesizer) until the pedal is released.

Still referring to FIG. 6, the velocity of each voice is controlled separately from the note number. A velocity source parameter 250, which controls the sensor signal selection by an associated multiplexer 252, selects the signal to be mapped into a velocity value.

The trigger delay parameter 254 specifies how long after detection of each note-on event the signal mapper waits (measured in units of milliseconds) before sampling the sensor signals specified by the pitch source and velocity source parameters 214, 250. The transmission of the note-on event to the synthesizer is delayed by the trigger delay amount so as to utilize the delayed readings of the pitch source (i.e., note number) and velocity source sensor signals. In some configurations, such as when the DRUM signal is used as a note-on trigger, a note-on trigger can be generated faster than accurate position and force signals can be read from the FSR's. In such cases, the trigger delay parameter 254 is needed to enable the sensor signal reading circuitry (104, FIG. 1) to obtain accurate FSR signals, which are needed to generate accurate note number and velocity values to be sent with the note-on event. When the trigger delay is not set to zero, typical values are 5 to 15 milliseconds.

The Output Min & Max and Curve parameters 256, 258 specify the way the selected sensor signal is mapped to a velocity value, where the Output Min and Max values specify the range of velocity values to be generated, and the Curve parameter 268 indicates whether the velocity function is to use a linear, cosine, exponential or square root mapping. Alternately, the programmer can specify a lookup table for defining the mapping from sensor signal to velocity value. The Symmetric parameter 260, when set to True, causes the velocity mapping function to be made symmetric about its midpoint, so as to peak at the center value for the sensor signal. The Default parameter 262 is a default velocity value that is used only if the velocity source parameter 250 is set to "off."

The velocity mapping function defined by the Min, Max, Curve and Symmetric parameters is automatically scaled so that the full defined range of values for the specified sensor signal is mapped by the mapping function into velocity values having the full range of values defined by the Min and Max parameters. For instance, Min and Max may be set to 1 and 127, respectively, since those are the smallest and largest defined non-zero MIDI velocity values.

Table 1 and 2 show the signal mapping parameters defining the signal mappings for two representative patches.

Giving the User Full Control by Disabling Note-On/Off Envelopes and Avoiding Note-On Events In a typical music synthesizer, when the user presses a keyboard key, or otherwise indicates that a note should be generated, the synthesizer doesn't simply turn on the circuitry (or software) for generating the appropriate note. Rather, the off-to-on transition of the note is controlled by an "attack" function or filter that multiplies the velocity for the note by a time varying attack envelope so as to produce a smooth off-to-on transition. Similarly, when the user releases the key or otherwise signals a note-off, the note velocity is multiplied by a note-off envelope so as to produce a smooth on-to-off transition. While the use of note-on/off envelopes is desirable in many contexts, the user typically has less control over the sound being produced by the synthesizer than the user would have when playing an acoustic instrument such as a violin, flute or the like.

In the present invention, a patch can be defined so as to "flat line" the music synthesizer, so as to disable the use of the on and off envelope functions. Instead, the note attack and release are controlled by the user via the sensor signal that is used to generate the amplitude control signal. As explained earlier, the amplitude control signal is a signal with a value that varies between 0 and 1 that is multiplied by the note velocity for each voice. For example, if the amplitude signal is generated as a linear (or any other full range) function of pressure on sensor FSR1 while the note pitch source is specified as being the location on FSR1, the user can control the note-on and off amplitude transitions though the application of time applying varying pressure to FSR1.

Also as described earlier, the present invention can be used to vary the pitch of a voice without generating MIDI note-on and note-off events, through the use of the pitch control signal. For example, the pitch for a voice can be set in accordance with the location touched in FSR1, while the pitch can be varied in accordance with the amount of pressure applied to FSR3. For this example, the pitch source for one of the two voices would be set to LOC1, while the pitch control signal would be coupled to the LOC3 sensor signal. If the pitch control signal is assigned an appropriate scale (i.e., an appropriate range between the Min and Max parameters for the pitch control function, such as 0 to 12000 or −6000 to +6000), then the pitch control signal can be used to vary the pitch of a voice over a range of many notes. If the pitch control signal is assigned a small scale (i.e., a small range between the Min and Max parameters for the pitch control function), then the pitch control signal can be used to vary the pitch of a voice over a corresponding range, typically close to the pitch of a particular note.

Thus, the present invention can vary the pitch and amplitude of a music synthesizer voice without generating any MIDI note-off and note-on events after the initial note-on event for turning on the voice.

Other Aspects of Patches

Many electronic music synthesizers, including the Yamaha VL1 used in the preferred embodiment, have configuration parameters that cannot be controlled through the use of MIDI events, but rather are defined by a configuration file that can be uploaded from the music synthesizer into a computer, or downloaded from the computer into the music synthesizer. These configuration parameters may control numerous aspects of the signal processing performed by the music synthesizer. For instance, some of the configuration parameters may be used to accomplish the flat lining of the attack and note-off envelopes described above.

Figure 7:
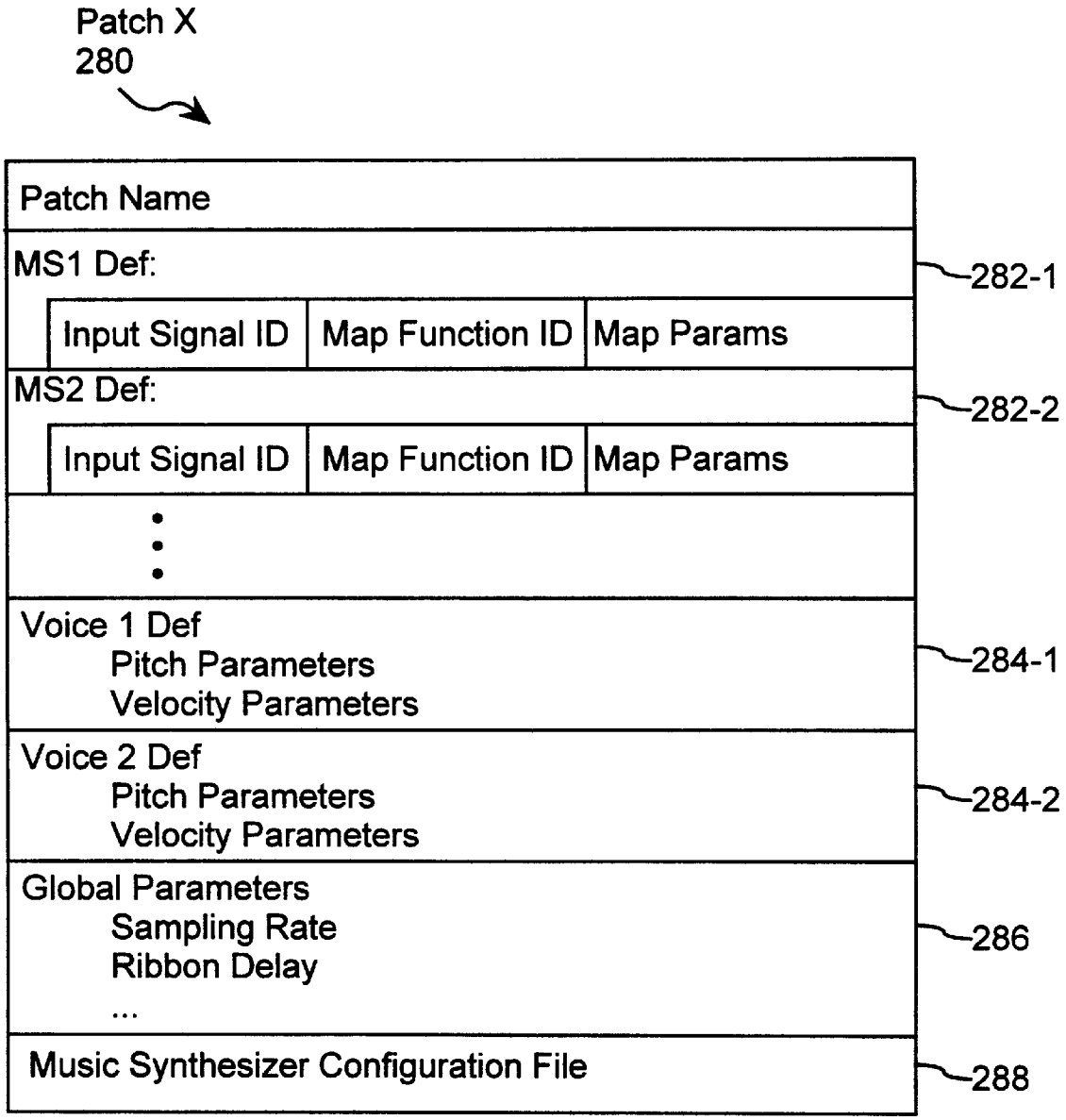
FIG. 7 depicts a patch data structure.

Referring to FIG. 7, in the preferred embodiment each patch 280 in the patch library 162 (see FIG. 3) is a data structure that contains the following types of parameters:

- parameter sets 282 for mapping the sensor signals to music synthesizer control signals MS1 to MSn; one of these parameter sets is graphically depicted in FIG. 5;
- parameter sets 284 for mapping sensor signals to voice pitch and velocity signals; one of these parameter sets 284 is graphically depicted in FIG. 6;
- global parameters 286 for specifying aspects of the signal mapper's operation that are either global in nature, or useable for generation by more than one signal mapping function; and
- a configuration file 288 to be downloaded into the music synthesizer each time the patch is selected.

Further Explanations

As explained above, the sensor signal to be mapped into each control signal is independently specified. As a result, individual ones of the sensor signals can each be mapped into a plurality of the control signals. In fact, since the number of control signals is generally larger than the number of sensor signals, typically at least a couple of the sensor signals are each mapped into two or more of the control signals. For instance, a single sensor signal such as LOC1 may be mapped to the pitch control signal, the pitch source of a voice, the note-on trigger source for that voice, as well as the tonguing control signal. In the preferred embodiment, there are eighteen control signals, including the four (pitch and velocity) for the two voices. Typically, only the six control signals LOCi and FRCi from the three FSR sensors are used to generate these control signals, while the other sensor signals are primarily used, if at all, for note-on triggering, sustain control, and octave transposition of the voices. While not all patches use all eighteen of the control signals, most patches use at least a dozen of the control signals, and thus on average each sensor signal is mapped to two or more control signals.

A topic not addressed above is quantization of the sensor signals and control signals. In some embodiments quantizing the sensor signals (e.g., into N steps, where N is typically a value between 2 and 100) may desirable so as to produce "clean transitions" between sounds, or to reduce the rate at which the control signals change value. Similarly, various ones of the control signals can be quantized by the signal mapping procedures 164 that generate them for the purpose of generating various musical effects.

Alternate Embodiments

While the preferred embodiment uses a particular set of control signals and a particular set of sensor signals, the present invention could be used with many other types of sensors, sensor signals and control signals. Typically, when the music synthesizer includes physical models for generating sounds similar to those generated by wind instruments, at least two or more of the control signals will be the same or similar to the asynchronous control signals used in the preferred embodiment. Furthermore, whenever the music synthesizer being used is MIDI compatible, and even if it is not, the control signals will also typically include pitch and velocity (or amplitude) control signals for one or more voices to be generated by the music synthesizer.

In some applications, such as small, portable music synthesizers that have a limited number of operating modes, much or all of the signal mapping of the present invention could be performed by hardwired or dedicated arithmetic and logic circuitry, thereby eliminating the need for a general purpose data processor.

Figure 8:
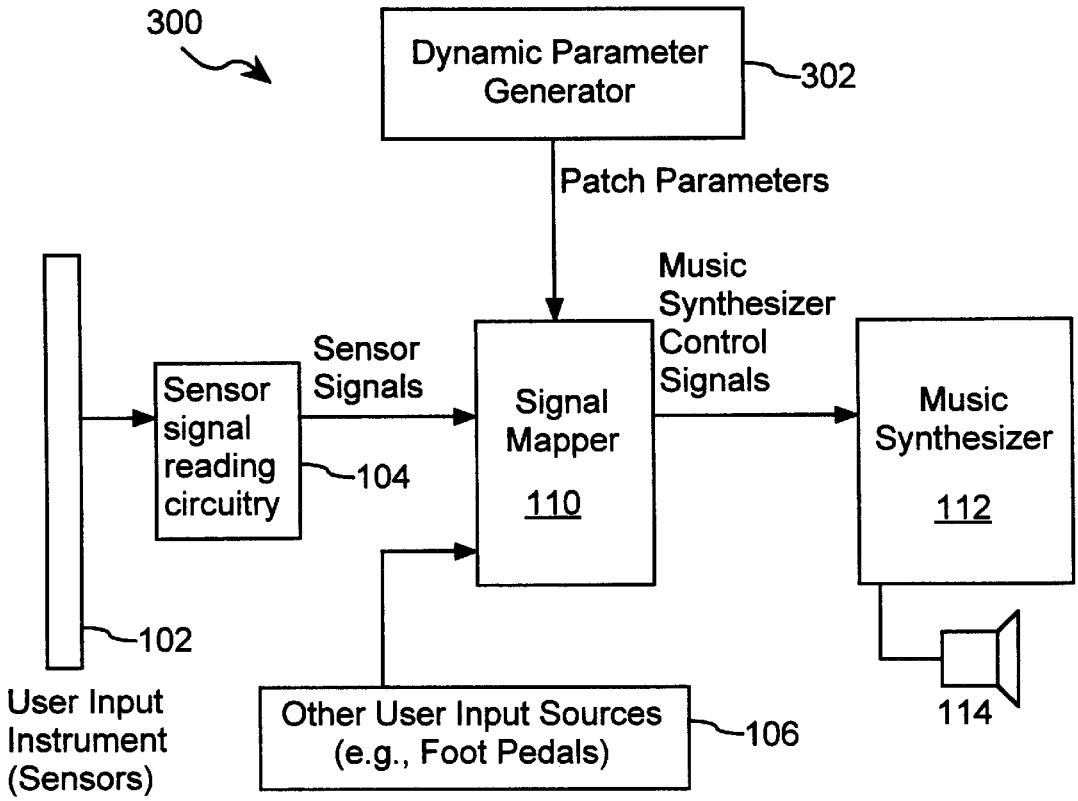
FIGS. 8 and 9 depict two alternate embodiments of a music synthesis system, each utilizing a dynamic parameter generator.

Referring to FIG. 8, in an alternate embodiment of a music synthesis system 300, some or all of the "patch parameters" (i.e., the signal mapping control values and coefficients) that are stored in a patch file in the preferred embodiments could be dynamically generated by a dynamic parameter generator 302. The patch parameters from the generator 302 dynamically change the signal mappings performed by the signal mapper 110. A suitable dynamic parameter generator is disclosed in U.S. patent application Ser. No. 08/801,085, filed Feb. 14, 1997, entitled "Computerized Interactor Systems and Methods for Providing Same".

Figure 9:
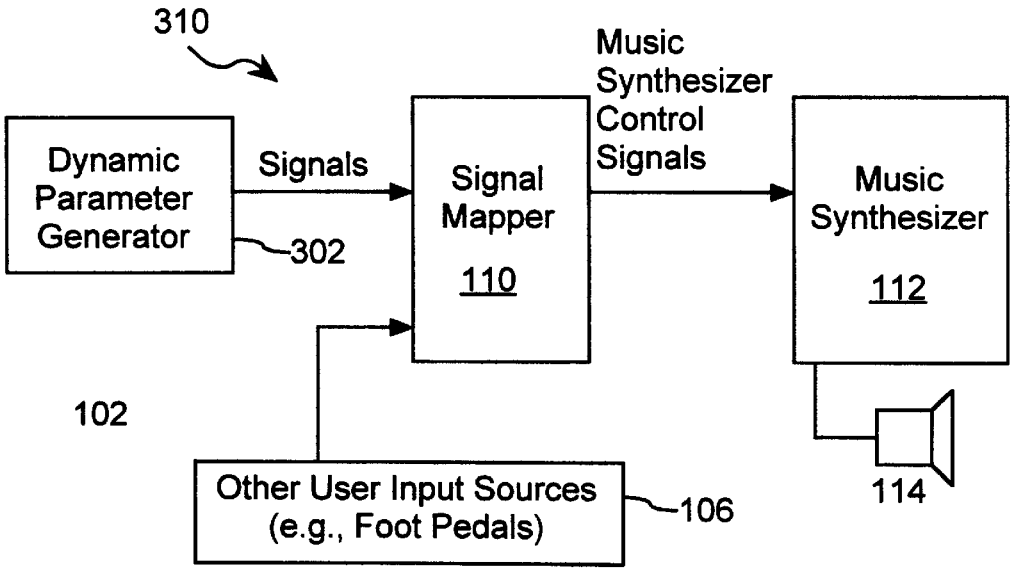

Referring to FIG. 9, in another alternate embodiment of a music synthesis system 310, the dynamic parameter generator 302 mentioned above could be used as the source of signals mapped by the signal mapper 110.

The "one to many" signal mapping technique that is applied to many of the sensor to control signal mappings in the present invention may also be useful in contexts other than music synthesis. That is, the mapping of each of a subset of the sensor signals to two or more distinct control signals may be a useful control signal generation technique in other contexts, such as for controlling complex industrial or commercial equipment.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

TABLE 1

| Patch 1 Parameters |
|---|
| Continuous Control Signal Definitions |
| Pressure: |
| Input Signal: FRC1 |
| Min = 0, Max = 127, Idle Mode = Min, Curve = Linear, Sym = No |
| Ribbon: N/A |
| Merge FRC2: FRC |
| Embouchure |
| Input Signal: FRC1 |
| Min = 127, Max = 0, Idle Mode = Min, Curve = Linear, Sym = No |
| Ribbon: N/A |
| Merge FSR2: FRC |
| Tonguing |
| Input Signal: LOC3 |
| Min = 0, Max = 127, Idle Mode = Min, Curve = Linear, Sym = No |

TABLE 1-continued

Patch 1 Parameters

Ribbon: N/A
Merge FSR2: Off
Breath Noise
Off
Scream
Off
Throat Formant
Off
Dampening
Off
Absorption
Off
Harmonic Enhancer
Off
Dynamic Filter
Off
Amplitude
Input Signal: FSR1, FRC
Min = 0, Max = 127, Idle Mode = Min, Curve = Cosine, Sym = No
Ribbon: N/A
Merge FSR2: FRC
Portamento
Off
Growl
Off
Pitch
Input Signal: LOC3
Min = 0, Max = 127, Idle Mode = Ribbon, Curve = Exponential, Sym = No
Ribbon: Scale = 200, Offset = 64, Set Point = 64, Inv = False
Merge FSR2: Off
Sample and Hold and Trigger Control Signal Definitions Voice1
Pitch Source: LOC1, inv = true
Pitch Set = 2, Transpose = 0, Octave = 1
Sustain: Off
Note-On: Off, Touch
Note-Off: LOC1, Release
Velocity Source = LOC1
Trigger Delay = 10
Input: Min = 10, Max = 126
Output: Min = 40, Max = 127
Curve = Linear
Symmetric = No
Voice2
Pitch Source: LOC2, Inv = False
Pitch Set = 6, Transpose = 12, Octave = 1
Sustain: Off
Note-On: Off, Touch
Note-Off: LOC2, Release
Velocity Source = LOC2
Trigger Delay = 10
Input: Min = 10, Max = 126
Output: Min = 40, Max = 127
Curve = Linear
Symmetric = No

TABLE 2

Patch 2 Parameters

Continuous Control Signal Definitions

Pressure:
Input Signal: FRC1
Min = 0, Max = 127, Idle Mode = Min, Curve = Cosine, Sym = No
Ribbon: N/A
Merge FSR2: FRC
Embouchure
Input Signal: LOC3
Min = 0, Max = 127, Idle Mode = Min, Curve = Linear, Sym = No
Ribbon: N/A
Merge FSR2: Off TABLE 2-continued Patch 2 Parameters Tonguing
Input Signal: LOC3
Min = 0, Max = 127, Idle Mode = Min, Curve = Linear, Sym = No
Ribbon: N/A
Merge FSR2: Off
Breath Noise
Input Signal: LOC3
Min = 0, Max = 127, Idle Mode = Min, Curve = Linear, Sym = No
Ribbon: N/A
Merge FSR2: Off
Scream
Off
Throat Formant
Off
Dampening
Input Signal: LOC3
Min = 0, Max = 127, Idle Mode = Min, Curve = Linear, Sym = No
Ribbon: N/A
Merge FSR2: Off
Absorption
Off
Harmonic Enhancer
Input Signal: FRC3
Min = 0, Max = 127, Idle Mode = Min, Curve = Linear, Sym = No
Ribbon: N/A
Merge FSR2: Off
Dynamic Filter
Input Signal: FRC3
Min = 0, Max = 127, Idle Mode = Min, Curve = Linear, Sym = No
Ribbon: N/A
Merge FSR2: Off
Amplitude
Input Signal: FRC1
Min = 0, Max = 127, Idle Mode = Min, Curve = Cosine, Sym = No
Ribbon: N/A
Merge FSR2: FRC
Portamento
Off
Growl
Off
Pitch
Input Signal: LOC3
Min = 127, Max = 0, Idle Mode = Ribbon, Curve = Linear, Sym = No
Ribbon: Scale = 175, Onset = 64, Set Point = 64, Inv = False
Merge FSR2: Off
Sample and Hold and Trigger Control Signal Definitions same as for Patch 1

What is claimed is:

1. A controller for use in conjunction with a music synthesizer and a plurality of sensors, the sensors generating a respective plurality of sensor signals, the controller comprising:

a data processing unit for executing a set of signal mapping functions;

an input port for receiving the plurality of sensor signals;

an output port for sending control signals to the music synthesizer; and a memory for storing data and instructions representing the set of signal mapping functions for execution by the data processing unit;

a first subset of the signal mapping functions each mapping a specified one of the sensor signals into a respective continuous control signal; and a second subset of the signal mapping functions each mapping specified ones of the sensor signals into respective note number and velocity control signals for at least one voice to be generated by the music synthesizer;

wherein at least two of the sensor signals are each mapped by the signal mapping functions into at least two of the control signals.

2. The controller of claim 1, wherein a third subset of the signal mapping functions each maps a specified one of the sensor signals into a note-on or note-off trigger for a corresponding voice;

the control signals that are generated by the second subset of signal mapping functions are sent to the music synthesizer when corresponding ones of the note-on triggers are generated; and the control signals that are generated by the first subset of signal mapping functions are sent to the music synthesizer without regard to the note-on and note-off triggers.

3. The controller of claim 1, wherein each of the signal mapping functions in the first subset is defined by a respective set of parameters, the respective set of parameters including a Min/Max range of control signal values, and a parameter specifying one of a predefined set of linear and non-linear mathematical functions to be used for mapping the specified sensor signal to the specified Min/Max range of control signal values.

4. The controller of claim 3, wherein two of the control signals generated by the signal mapping functions in the first subset a generated using first and second distinct mathematical functions.

5. The controller of claim 1, wherein a first pair of the sensor signals represent a location where a user is touching a first one of the sensors and an amount of force with which the user is touching the first sensor, and a second pair of the sensor signals represent a location where a user is touching a second one of the sensors and an amount of force with which the user is touching the second sensor.

6. A controller for use in conjunction with a music synthesizer and a plurality of sensors, the controller comprising:

means for receiving a continuously changing set of sensor signals from the sensors in response to physical gestures made by a person;

means for mapping the received sensor signals into control signals, wherein a one-to-many mapping is performed on each of a subset of the sensor signals so as to generate multiple control signals from each sensor signal in the subset; the subset including at least two distinct sensor signals; and means for sending the control signals to the music synthesizer so as to generate audio signals responsive to the person's physical gestures;

wherein the subset includes at least two sensor signals and at least two of the control signals sent to the music synthesizer are continuously varying in value while the person is performing the physical gestures.

7. The controller of claim 6, wherein at least two of the sensors are multidimensional sensors that each generate at least two of the sensor signals, each multidimensional sensor generating the at least two sensor signals in response to at least two distinct aspects of the physical gestures.

8. A method of generating a plurality of control signals for use by a music synthesizer, comprising the steps of:

receiving a continuously changing set of sensor signals from a set of sensors in response to physical gestures made by a person;

mapping the received sensor signals into control signals, wherein a one-to-many mapping is performed on each of a subset of the sensor signals so as to generate multiple control signals from each sensor signal in the subset; the subset including at least two distinct sensor signals; and sending the control signals to the music synthesizer so as to generate audio signals responsive to the person's physical gestures;

wherein the subset includes at least two sensor signals and at least two of the control signals sent to the music synthesizer are continuously varying in value while the person is performing the physical gestures.

9. The method of claim 8, wherein at least two of the sensors are multidimensional sensors that each generate at least two of the sensor signals, each multidimensional sensor generating the at least two sensor signals in response to at least two distinct aspects of the physical gestures.

10. A method of generating a plurality of control signals for use by a music synthesizer, comprising the steps of:

receiving a plurality of sensor signals;

generating a first subset of the control signals by mapping, in accordance with a first set of signal mapping functions, specified ones of the sensor signals into the first subset of the control signals; each of the signal mapping functions in the first set mapping a specified one of the sensor signals into a respective one of the control signals;

sending the generated control signals in the first subset to the music synthesizer;

generating note number and velocity control signals for at least one voice to be generated by the music synthesizer by mapping, in accordance with a second set of signal mapping functions, specified ones of the sensor signals into note number and velocity control signals for at least one voice to be generated by the music synthesizer; and sending note-on events to the music synthesizer that include the generated note number and velocity control signals for the at least one voice;

wherein at least two of the sensor signals are each mapped by the signal mapping functions into at least two of the control signals.

11. The method of claim 10, further including generating note-on and note-off triggers for at least one voice by mapping, in accordance with a third set of signal mapping functions, specified ones of the sensor signals into the note-on and note-off triggers; wherein the note-on events are sent to the music synthesizer when corresponding ones of the note-on triggers are generated; and the first subset of the control signals are sent to the music synthesizer without regard to the note-on and note-off triggers.

12. The method of claim 10, wherein each of the signal mapping functions in the first subset is defined by a respective set of parameters, the respective set of parameters including a Min/Max range of control signal values, and a parameter specifying one of a predefined set of linear and non-linear mathematical functions to be used for mapping the specified sensor signal to the specified Min/Max range of control signal value.

13. The method of claim 10, wherein two of the control signals generated by the signal mapping functions in the first subset use different mathematical functions to generate their respective control functions.

14. The method of claim 10, wherein a first pair of the sensor signals represent a location where a user is touching a first one of the sensors and an amount of force with which the user is touching the first sensor, and a second pair of the sensor signals represent a location where a user is touching a second one of the sensors and an amount of force with which the user is touching the second sensor.

15. The method of claim 10, wherein the control signals generated by the signal mapping functions in the first subset include at least two continuously varying control signals that affect human perceptible qualities of sounds generated by the music synthesizer.

16. The method of claim 10, wherein the control signals generated by the signal mapping functions in the first subset include at least two control signals that set corresponding respective music synthesis parameters in the music synthesizer, the respective synthesis parameters selected from the set consisting of pressure, embouchure, tonguing, breath noise, scream, throat formant, dampening, absorption, harmonic filter, dynamic filter, portamento, and growl.

* * * * *